United States Patent [19]

Baumann

[11] 4,389,831

[45] Jun. 28, 1983

[54] SIMPLIFIED CONSTRUCTION SYSTEM

[75] Inventor: Hanns U. Baumann, Laguna Beach, Calif.

[73] Assignee: Sharon K. Baumann Trust, Laguna Beach, Calif.

[21] Appl. No.: 266,834

[22] Filed: May 26, 1981

[51] Int. Cl.[3] ..... E04G 21/00

[52] U.S. Cl. ..... 52/741; 52/745; 52/125.1; 52/125.5; 52/293; 264/35; 249/34

[58] Field of Search ..... 52/741, 745, 293, 125.1, 52/125.2, 126; 264/31, 34, 35; 249/13, 18, 19, 26, 27, 34, 188, 35

[56] References Cited

U.S. PATENT DOCUMENTS

| | | | |
|---|---|---|---|
| 1,066,436 | 7/1913 | Peltzer | 52/745 |
| 1,326,400 | 12/1919 | Halverson et al. | 264/35 |
| 1,678,504 | 7/1928 | Glover | 52/293 |
| 2,372,200 | 3/1945 | Hayes | 52/293 |
| 2,794,336 | 6/1957 | Ballou | 52/745 |
| 2,960,745 | 11/1960 | Wallace | 52/293 |
| 3,494,092 | 2/1970 | Johnson et al. | 52/745 |
| 3,834,095 | 9/1974 | Ohlson | 52/259 |
| 4,030,257 | 6/1977 | Labie et al. | 52/125.1 |
| 4,036,564 | 7/1977 | Richards | 417/344 |
| 4,046,584 | 9/1977 | Snyder et al. | 506/90 |
| 4,147,009 | 4/1979 | Watry | 52/744 |

FOREIGN PATENT DOCUMENTS

| | | | |
|---|---|---|---|
| 796762 | 1/1936 | France | 264/35 |
| 973716 | 8/1950 | France | 52/259 |
| 331272 | 10/1935 | Italy | 71/ |

*Primary Examiner*—James L. Ridgill, Jr.
*Attorney, Agent, or Firm*—James W. Lucas

[57] ABSTRACT

A simplified box-like building is constructed one room at a time. Concrete slabs are used for walls, floor and ceiling, and are poured in a horizontal position, stacked vertically with bond-breaking layers between them to allow separation. After the foundation and stub wall are partially cured, the ceiling slab is poured with wedge-shaped edges clearing stub walls by approximately one inch. Tiltable wall slabs are then poured on top of the ceiling slab, each connected by hinges to its own stub wall. An accelerated light weight low-slump concrete is normally used, and makes possible a rapid nearly continuous pouring sequence.

Erection of the building is also rapid. The light weight walls are tilted up by hand, pivoting about their base hinges. While they are temporarily held in position, the wall edge dowel reinforcement is bent out and single-side corner forms are positioned or expanded metal is attached to the dowels. The corner joint is sprayed with accelerated low-slump concrete to form a unit, and hollowed areas at the bases of walls are sprayed to form shear connections to the stub walls at the dowels. Removable light weight beams supporting winches are placed across the upper corners, and the ceiling slab is manually raised by winching into place. Dowel reinforcement bars are bent out and accelerated concrete joins the wall tops to the ceiling slab edges to complete the unit. The process is repeated for multi-story buildings and for multiple rooms on each floor. Due to the nature of the accelerated concrete, the process can be done nearly continuously by uniskilled labor using only one piece of powered equipment which is the concrete mixer-pump-sprayer machine.

13 Claims, 9 Drawing Figures

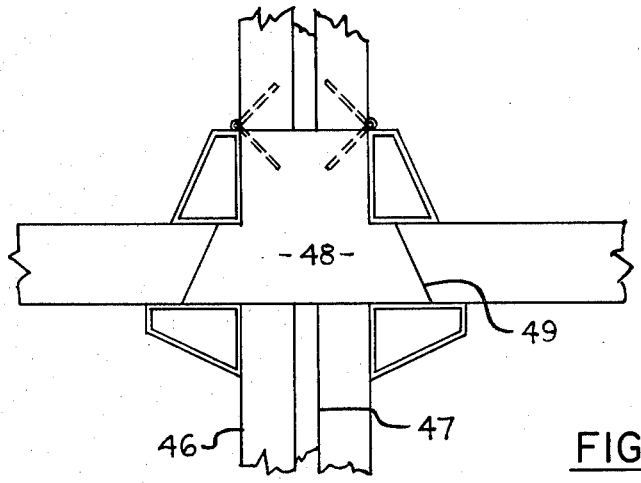
FIG. 7
FIG. 8
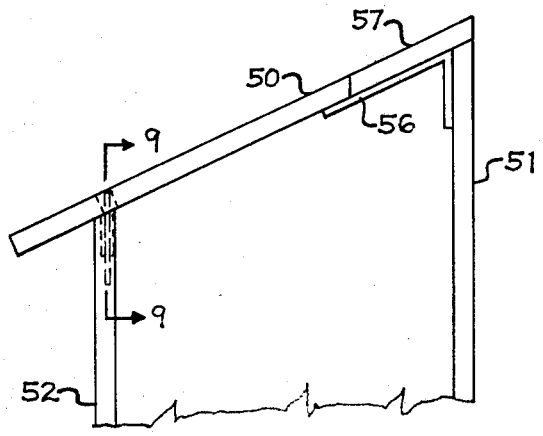
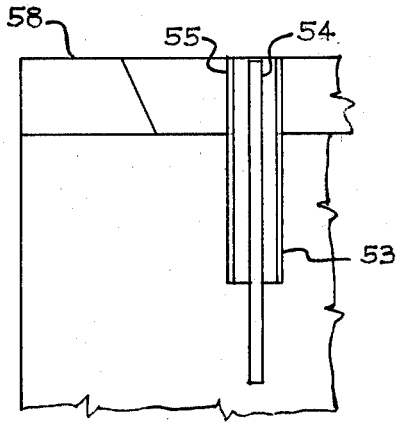
FIG. 9

SIMPLIFIED CONSTRUCTION SYSTEM

BACKGROUND OF THE INVENTION

This invention relates generally to building structures made of concrete, and more particularly to those cast on the building site and assembled by tilting the walls into a vertical position.

Prior art buildings of the "tilt-up" type have required long periods of curing of the concrete, in order to develop sufficient strength to be moved around into position and connected into place. In the past, this type of construction has been used mostly for single story industrial buildings, since they do not require a second floor. A wooden roof with beams can then provide the structure tying together the tops of the walls.

As higher tilt-up wall panels are poured, thicknesses must increase to allow sufficient strength for them to be hoisted into position. Larger floor areas must also be available for the initial pouring in a horizontal position. Hoists of greater capacity are required to lift them, and the whole operation becomes much more expensive.

There have been several attempts to provide horizontally cast ceiling panels that can then be hoisted into position. One such system is found in U.S. Pat. No. 1,066,436 issued July 1, 1913 to Pelzer. In this case, columns are formed, then used to raise the ceiling panels. In U.S. Pat. No. 4,030,257 issued June 21, 1977 to Labie et al., a floor slab is disclosed that can be poured in nested fashion, with reinforcing beams added to each floor when on top of the stack, providing bending strength while being lifted into final position. The floors are then bolted to the vertical supporting walls. Watry, in U.S. Pat. No. 4,147,009 issued Apr. 3, 1979 casts floor panels in small sections and assembles them in place with tension cables and mortar.

It is a well-recognized need that the present invention addresses, particularly in the low-cost housing area. A primary object of this invention is therefore to provide a rapid and simplified system for constructing housing units.

Another object is to allow high quality inexpensive housing to be constructed without the use of expensive construction equipment.

An additional object is to develop a construction system that takes advantage of the rapid-curing and light weight and thermal insulating characteristics of accelerated low-slump concrete.

A further object of the invention is the elimination of the necessity for mechanical connections between concrete elements.

Another object is the provision of a simple system for elevating floor slabs, and for tying them into the wall structures.

A still further object of the invention is to disclose a structural unit that can be repeated to form multi-story and multiple-room buildings, eliminating the need for large wall panels.

SUMMARY OF THE INVENTION

A novel system of concrete building construction is disclosed within the present invention. The sequence of events described constitutes a simple and rapid method of construction that requires a minimum amount of machinery for erecting and eliminates mechanical connections. It could be used to advantage with standard concrete, if enough units were built concurrently to occupy the construction crew during the curing time required before the slabs could be lifted.

However, small numbers of units can be built economically if an accelerated low-slump concrete is used. Such a material could have characteristics similar to those described in U.S. Pat. No. 4,046,584 issued to Snyder. Gilmore needle times of 34 seconds initial and 18 minutes final are indicated. The material is best poured into the forms by a concrete mixer-pump-sprayer machine similar to that disclosed in U.S. Pat. No. 4,036,564 issued to Richards on July 19, 1977. The accelerators can be added just as the mixture is leaving the feeder, thus starting the prehardening just after the concrete leaves the hose.

When my novel construction is used with the aforementioned accelerated low-slump concrete, some startling economies can be realized. Tilting-up of the sidewall slabs, for instance, is vastly simplified by having the base already hinged about its final location. This arrangement provides leverage for lifting the top of the wall into a vertical position rather than having to hoist the entire wall into the air and maneuver the base into place for fastening to the foundation. Where two walls come together to form a corner, the low-slump material can be sprayed into a simple external corner mold, or against metal lath, with the concrete itself holding shape while being smoothed, or screed, on the inside to form the internal corner.

At the location of wall dowels the inner surface of the sidewall base has boxed-out areas, approximately two-thirds of the wall thickness, between the aforementioned hinges. These areas are sprayed with low-slump material to provide a permanent tie between the sidewall and the stub wall which is part of the foundation. After the four walls have thus been tied together and to the foundation, four winches can be placed across the upper corners of the walls, and the ceiling slab raised into bent out position. Again, dowels and accelerated material are used to tie the ceiling into the tops of the walls. The edges of the ceiling slab are tapered to wedge them against the added material.

The above-described method can easily be repeated for a second floor, using the ceiling slab as a base for casting the panels needed for the next sequence.

Other features and advantages of the invention will become apparent when further described in terms of a preferred embodiment.

BRIEF DESCRIPTION OF THE DRAWINGS

In the accompanying drawings:

FIG. 7 is a typical sectional view where a common wall is used to support two ceiling slabs;

FIG. 8 is a sectional view through a sloped ceiling slab, showing the development of an eave;

FIG. 9 is a section taken along lines 9—9 in FIG. 8 showing a typical shear connection to the lower wall at an eave.

DETAILED DESCRIPTION OF A PREFERRED EMBODIMENT

The simplified construction method of the present invention saves a great deal of time and eliminates the need for expensive equipment. It could actually be used with ordinary concrete, but the primary time saving results from the use of a machine similar to the aforementioned Richards machine. Very rapid curing concrete coming from this machine can start hardening immediately, which results in an accelerated low-slump material that is self-supporting. Forms can therefore be very simple and light. A typical time required for the poured panels to reach lifting strength is one hour.

A second floor is produced in the same manner used for the first floor. This means that concrete slabs are poured at the second floor level, so no cranes are necessary to lift them from ground level.

Figure 1:
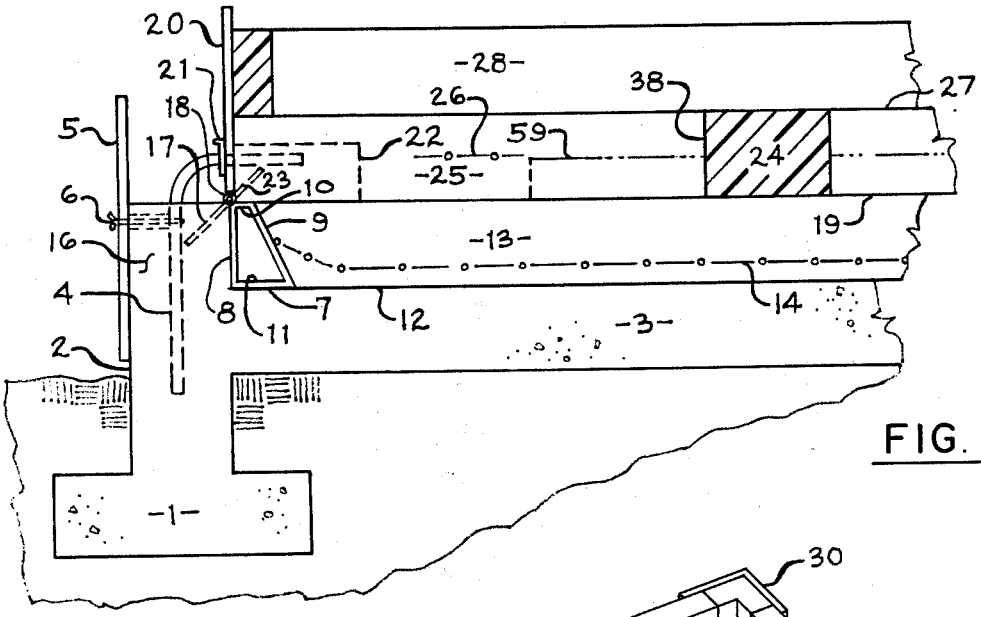
FIG. 1 is a sectional view through the central area of a preferred embodiment, showing all slabs poured but not yet erected.

A typical construction begins with excavation of the footing trench, and placing reinforcing bars and dowels in the stem wall area. A plastic film is normally laid over the foundation slab area, and rough plumbing and electrical lines put in place. Referring now to FIG. 1, footing 1 can be seen joined to stem wall 2 when foundation slab 3 is poured. Reinforcing dowels 4 are vertical and imbedded in the stem wall at about three foot spacings. Exterior form 5 is positioned against the outer surface of stem wall 2 by looping wires 6 around dowels 4, and extends at least one wall thickness above the upper surface of foundation slab 3. Interior form 7 is positioned on the slab upper surface so that vertical side 8 faces away from the center of foundation slab 3 and aligns with the desired inner surface of the outer wall. Form 7 is shown having a sloping inner wall 9, so that upper dimension 10 is less than lower dimension 11.

Figure 4:
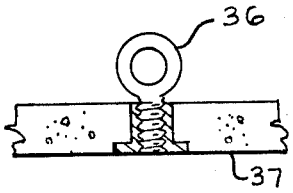
FIG. 4 is a sectional view taken along lines 4—4 in FIG. 2 showing a typical corner lift insert with an eyebolt in place.

A plastic sheet 12 is applied as a bond-breaking layer to the upper surface of foundation 3. Ceiling slab 13 is poured over the bond-breaking layer, after wire mesh reinforcement 14 is positioned just above plastic sheet 12 (about ¾ inch above sheet 12). Threaded lift inserts 15, best seen in FIG. 4, are placed in each corner, and include a threaded filler to come out flush with both surfaces of the slab to be poured. Stub wall 16 is poured between interior form 7 and exterior form 5, and hinge rods 17, with circular loops 18 on the upper ends, are imbedded in stub wall 16 at an approximate 45° angle at about three foot spacings, alternating with dowels 4.

An additional bond-breaking plastic sheet 19 is applied to the upper surface of ceiling slab 13, and reinforcing dowels 4 are bent down and inward, parallel to the upper surface of slab 13 and about half the wall thickness above that surface. Inwardly-facing vertical form 20 is aligned with the inside face of stub wall 16 and held in place by clips 21. Horizontal forms 22 are slipped over the upper ends of dowels 4 to contact form 20, extending inwardly to block out portions of the desired tiltable wall thickness. Rods 23 are bent to cooperate with loops 18 of hinge rods 17, and are supported up at approximately 45° in the area of the sidewall to be poured. Filler 24 has two vertical surfaces and is of the same thickness as that of the sidewall to be poured. It is used to make up the difference between the lengths of the two sidewalls and the width of foundation slab 3. Tiltable sidewall slab 25 is then poured over plastic sheet 19, up to the thickness of filler 24, and includes wire mesh 26 running through the center.

If a second floor is to be added as later shown in FIG. 6, extensions 59 are included in filler 24. The thinner section thus formed at the top of sidewall slab 25 will act as an integral edge form for pouring when ceiling slab 13 is attached to sidewall 25.

Figure 2:
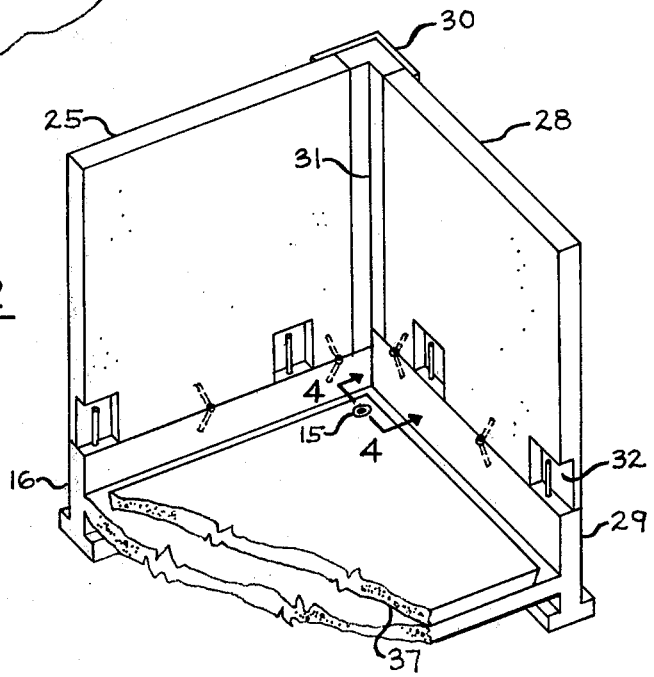
FIG. 2 is an isometric view of an inside corner after wall erection but before the ceiling is raised, broken away to show the wall connections.
Figure 3:
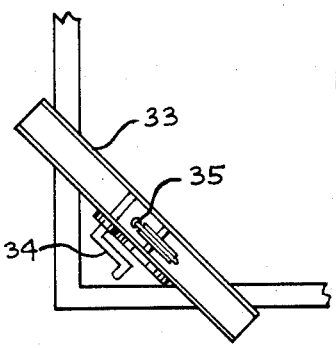
FIG. 3 is a plan view showing a typical corner winch in place for raising the ceiling slab.

Another bond-breaking layer 27 is applied over sidewall 25 and filler 24, so that tiltable endwall slab 28 can be poured. As best seen in FIG. 2, stub wall 29 must be at a higher level than stub wall 16, since endwall 28 must hinge about a higher point to lie flat on top of sidewall 25. A similar arrangement of hinges and dowels bent into more forms 22 is used at the top of stub wall 29. Indeed, if the lengths of two opposing sidewalls happen to total more than the width of the foundation slab, three levels of tiltable walls could be required to accommodate the resulting overlap.

Sidewall 25 and endwall 28 are then erected, pivoting about their respective mating hinging members, and resting on their respective stub walls. It should be noted that lightweight concrete may be used which makes walls 25 and 28 light enough to be erected by hand. Once two adjacent walls have been erected, vertical angular form 30 is positioned exteriorly to create a corner area. Mesh extending from the two wall edges is lapped, and a vertical wire 31 strung to mark the inside corner. An accelerated low-slump concrete is sprayed into the corner area from the inside, and smoothed over the approximate four inch distance from the wall slabs to wire 31 to form an inside corner. The process is repeated in all corners to form a vertical box structure.

Horizontal forms 22 are still in place over bent reinforcing dowels 4. These forms are now removed, and dowels 4 straightened into a vertical configuration inside blocked-out portions 32 of each wall, formed by forms 22. An accelerated low-slump concrete is sprayed into portions 32 and smoothed to form a flat inside surface, providing a shear connection between the tilted-up walls and their respective stub walls.

Diagonal supports 33 are placed across each upper corner between adjacent walls, and elevating winches 34 are put in place. Cables 35 are attached to ceiling slab 13 by hooking into eyebolts 36, which temporarily replace the threaded fillers in lift inserts 15. These are best seen in FIG. 4. Ceiling slab 13 is elevated into position by winches 34, with bottom surface 37 aligned with top surfaces 38 of walls 25 and 28. The ceiling is shored up at this location, and winches 34 and supports 33 removed.

Figure 5:
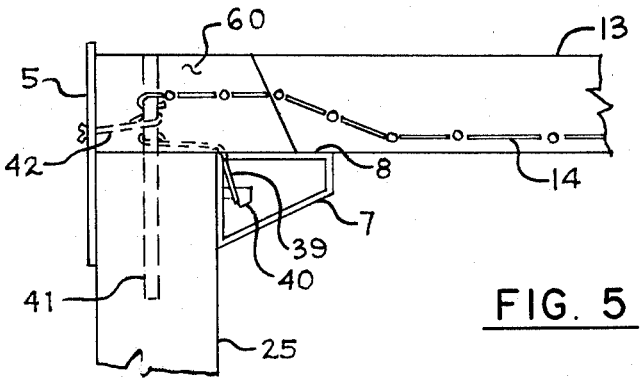
FIG. 5 is a typical sectional view taken through the top of a sidewall after the ceiling is in place, showing the forms and support used while pouring the interconnection.

As best shown in FIG. 5, interior form 7 is moved from its original position on foundation slab 3, and added between the bottom of elevated ceiling slab 13 and the inner surface of sidewall 25. Form 7 is rotated 90° for this purpose, with original vertical side 8 now being in a horizontal position. Form 7 is held in position by having wire loops 39 engaging interior protrusions 40 in form 7, and passing around additional reinforcing dowels 41 in the upper end of sidewall 25. Exterior form 5 is moved from its original position outside stub wall 16 and relocated outside the upper edge of wall 25, held there by additional wire loops 42 around dowels 41. After wire mesh reinforcement 14 in ceiling slab 13 is lapped with mesh 26, area 60 is filled with concrete and the forms removed by cutting wire loops 39 and 42. The process is repeated at the top of each wall. The advantage of having ceiling slab 13 formed with its upper dimension greater than its lower dimension can now be seen. The weight of slab 13 is resisted by tension in wire mesh reinforcement 14, as well as by the "Keystone" effect converting vertical shear into a horizontal force at the walls.

Figure 6:
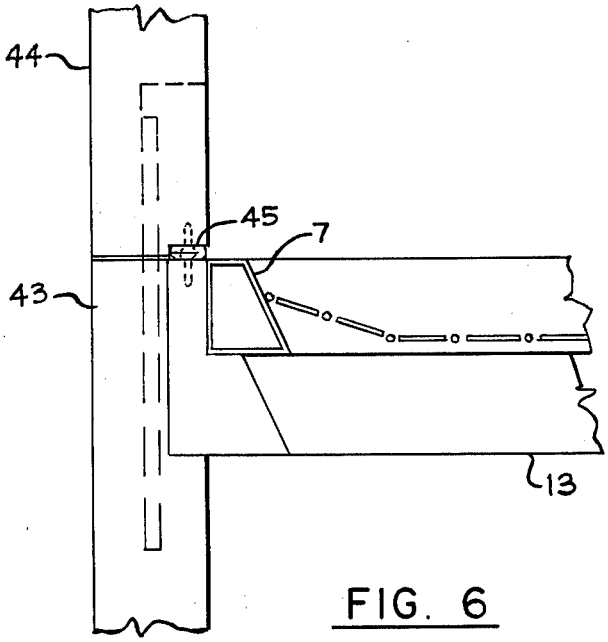
FIG. 6 is a sectional view through the wall-to-ceiling corner showing the process of adding a second floor.

Referring now to FIG. 6, the same view as FIG. 5 is shown, but after several steps have been taken to add a second floor to the previously erected first floor structure. An additional stub wall 43 has been poured, after moving interior form 7 from the position shown in FIG. 5 to the same position shown in FIG. 1 relative to the non-elevated ceiling slab. Since the wall pouring and erecting procedure is identical to that described above, new sidewall 44 is shown in the erected position. An alternate hinge 45 is shown, which was attached to stub wall 43 and sidewall 44 after hardening. A 90° angular metal piece is used, with a notch at the vertex to facilitate bending during the hinging action. In some cases, hinge 45 may be strong enough to carry the horizontal shear load, and the vertical dowels may be eliminated. A third alternate hinge, not illustrated, results from a pivotal connection between intersection dowels.

FIG. 7 shows a common wall made up of two tiltable walls 46. In this application, each wall can be thinner than when acting above, and thermal and acoustical insulating material 47 can be inserted between walls 46 to make a sandwich with excellent soundproofing and insulating qualities. The cap 48 for this wall is formed with a wedge-shaped edge 49 at each end, by pouring between adjacent shored-up ceiling slabs. Two of forms 7 are used as shown in FIG. 5, and an additional two are used as shown in FIG. 6. Cap 48 thus ends up with its own stub wall portion for supporting an additional set of vertical walls.

An alternate treatment of a ceiling slab 50 as a roof is shown in FIG. 8. The top surfaces of high sidewall 51 and low sidewall 52 are molded on an angle corresponding to the final desired roof angle. As best seen in FIG. 9, metal cans 53 are molded into the top of wall 52, separated from reinforcing dowels 54 by removable forms. Corresponding metal cans 55 have been molded into ceiling slab 50 to match the approximate three foot spacings between adjacent dowels 54. After ceiling slab 50 is elevated to align with the tops of sidewalls 51 and 52, slab 50 is slid over the top of low wall 52 to create an eave, with dowels 54 protruding into the open area inside cans 55 in slab 50. As shown in FIG. 9, concrete is poured into aligned cans 53 and 55 and around dowels 54, forming concrete columns to provide a shear connection between slab 50 and wall 52. Form 56 is then positioned between high sidewall 51 and the bottom of slab 50. Outer forms are added, and concrete poured into areas 57 and 58 to complete the structure.

As will be seen from the foregoing, one preferred version of my invention has been described in great detail. Variations will be apparent to those skilled in the art, but which do not depart from the spirit of the disclosure. I therefore wish my invention to be limited only by the scope of the following claims.

I claim:

1. A method of constructing a reinforced concrete building of the tilt-up type comprising the steps of:

a. pouring a concrete slab foundation, including peripheral footings, b. positioning an exterior form for the outer wall extending upwardly at least one wall thickness above the upper surface of said foundation, c. positioning an interior form on the upper surface of said foundation so that the vertical side of said form faces away from the center of said foundation and aligns with the desired inner surface of the outer wall, said form having an upper dimension less than its lower dimension, d. applying a bond-breaking layer to the upper surface of said foundation, e. pouring a ceiling slab over said bond-breaking layer including corner lift inserts and reinforcement just above said bond-breaking layer, f. pouring a stub wall between said interior form and said exterior form including a member for hinging about the upper inner corner of said stub wall, g. applying a bond-breaking layer to the upper surface of said ceiling slab, h. positioning an inwardly-facing vertical form above said stub wall, i. pouring a tiltable sidewall slab over said bond-breaking layer including a mating portion for said hinging member, j. erecting said tiltable sidewall while pivoting about said mating hinging members, k. erecting an adjacent tiltable sidewall to form a corner area, l. interconnecting said adjacent sidewalls in said corner area, m. positioning elevating means across adjacent sidewalls above said corner areas, n. elevating said ceiling slab by attaching said elevating means to said ceiling slab at said corner lift inserts, o. adding form means between the bottom of said elevated ceiling slab and the inner surface of said sidewall, p. filling in the area above said added form means to connect the edge of said ceiling slab with said sidewall.

2. Claim 1 wherein said interconnecting in step (l) includes the steps of:

positioning a vertical angular form exteriorly of said corner area, spraying an accelerated low-slump concrete into said area and smoothing to form an inside corner.

3. Claim 1 wherein step (p) is followed by the further steps of:

positioning an exterior form for the outer wall extending upwardly at least one wall thickness about the upper surface of said ceiling slab, positioning an interior form on the upper surface of said ceiling slab so that the vertical side of said form faces away from the center of said ceiling slab and aligns with the desired inner surface of the outer wall, said form having an upper dimension less than its lower dimension, applying bond-breaking layer to upper surface of said ceiling slab, repeating steps (e) through (p).

4. Claim 1 wherein the form means of step (o) are identical to the interior form of step (c).

5. Claim 1 wherein step (g) is followed by the further step of:

positioning an additional vertical form on the upper surface of said ceiling slab to define the upper end of a tiltable sidewall.

6. Claim 5 wherein said additional vertical form includes a filler of substantially the same thickness as that of said tiltable sidewall, and wherein step (l) is followed by the further steps of:

applying a bond-breaking layer to the upper surface of said sidewall slab, positioning additional vertical forms on the upper surface of said sidewall slab to define the ends of an additional tiltable sidewall, pouring an additional tiltable sidewall slab over said bond-breaking layer including means for hinging said sidewall from another stub wall.

7. Claim 1 wherein step (h) is followed by the further step of:

positioning a plurality of horizontal forms in contact with said inwardly-facing vertical form, said horizontal forms extending inwardly and blocking out a portion of the desired tiltable wall thickness.

8. Claim 7 wherein step (j) is followed by the further step of:

spraying an accelerated low-slump concrete into said blocked-out portions of said sidewall and smoothing to form a flat inside surface.

9. Claim 1 wherein step (o) is replaced by the steps of:

sliding said ceiling slab over the top of a wall opposite said sidewall to create an eave, adding shear connecting means between said ceiling and said wall, positioning a form between said sidewall and the bottom of said ceiling slab, 10. Claim 9 wherein said shear connecting means include a plurality of reinforcing dowels surrounded by poured concrete columns.

11. In a reinforced concrete building of the tiltable type, the combination of:

a concrete slab foundation, a ceiling slab and at least one wall slab resting thereon and parallel thereto, said foundation including stub walls along the periphery thereof, said ceiling slab being between said foundation and said wall slab and separated therefrom by a bond-breaking layer, said ceiling slab having an upper dimension greater than its lower dimension, and hinging means connecting said wall slab to one of said stub walls.

12. Claim 11 wherein said hinging means includes a bent rod cooperating rotatably with a circular loop, said means being effective to locate the base of said wall slab while said slab is tilted to a vertical position.

13. A reinforced concrete building comprising:

a concrete slab foundation, at least four vertical wall slabs and a ceiling slab, said vertical walls being supported by said foundation and interconnected therewith through a plurality of dowel-reinforced and sprayed concrete areas, said vertical walls having corner intersections reinforced with wire mesh and filled with sprayed concrete, said ceiling slab having an upper dimension greater than its lower dimension, the area between the upper ends of said vertical wall slabs and the outer edges of said ceiling slab being reinforced with wire mesh and filled with sprayed concrete, said foundation, vertical walls and ceiling thus forming an integral structural unit.

* * * * *